US010968631B2

(12) United States Patent
Ehsani

(10) Patent No.: US 10,968,631 B2
(45) Date of Patent: Apr. 6, 2021

(54) STRUCTURE REINFORCEMENT PARTIAL SHELL

(71) Applicant: Mohammad R. Ehsani, Tucson, AZ (US)

(72) Inventor: Mohammad R. Ehsani, Tucson, AZ (US)

( * ) Notice: Subject to any disclaimer, the term of this patent is extended or adjusted under 35 U.S.C. 154(b) by 21 days.

(21) Appl. No.: 13/859,596

(22) Filed: Apr. 9, 2013

(65) Prior Publication Data

US 2014/0298656 A1 Oct. 9, 2014

(51) Int. Cl.
*E04C 5/07* (2006.01)
*E04G 23/02* (2006.01)

(52) U.S. Cl.
CPC ..... *E04C 5/07* (2013.01); *E04G 23/0218* (2013.01); *Y10T 29/49616* (2015.01); *Y10T 428/24149* (2015.01); *Y10T 442/20* (2015.04); *Y10T 442/2902* (2015.04); *Y10T 442/2926* (2015.04); *Y10T 442/2984* (2015.04); *Y10T 442/2992* (2015.04)

(58) Field of Classification Search
CPC ..... Y10T 29/49623; Y10T 29/49625; Y10T 29/49627; Y10T 29/49631; Y10T 29/49632; Y10T 29/49634; Y10T 29/49616; Y10T 29/49618; E04C 5/01; E04C 5/07
See application file for complete search history.

(56) References Cited

U.S. PATENT DOCUMENTS 5,043,033 A * 8/1991 Fyfe ..... B29C 70/56 156/71
5,657,595 A * 8/1997 Fyfe ..... E01D 22/00 156/71
8,713,891 B2 * 5/2014 Carr et al. ..... 52/745.17
2009/0056237 A1 * 3/2009 Dickinson ..... E04B 1/34321 52/79.5

* cited by examiner

*Primary Examiner* — Rick K Chang
(74) *Attorney, Agent, or Firm* — Arjomand Law Group

(57) ABSTRACT

A method and an article of manufacture are disclosed for reinforcing various structures with only partially accessible circumference, such as columns closely adjacent to or protruding out of a wall or beams holding a ceiling. Some of these structures may be partly or completely submerged in water, such as retaining walls on the sides of rivers and water-ways. In some embodiments a prefabricated shell will fully or partly cover the exposed and reachable part of the structure and will be secured in place by various means. The shell may hug the structure tightly or loosely and the space between the shell and the structure may be filled with such curable materials as glue, epoxy, grout, concrete and the like. In various embodiments additional reinforcement such as rebar may be placed in the space between the shell and the structure.

9 Claims, 2 Drawing Sheets

STRUCTURE REINFORCEMENT PARTIAL SHELL

CROSS-REFERENCE(S) TO RELATED APPLICATION(S)

This application is related to the U.S. patent application Ser. No. 13/077,854, filed on Mar. 31, 2011, and the U.S. patent application Ser. No. 13/409,688, filed on Mar. 1, 2012, and the U.S. patent application Ser. No. 13/488,359, filed on Jun. 4, 2012.

TECHNICAL FIELD

This application relates generally to construction. More specifically, this application relates to a method and apparatus for reinforcing structures using a prefabricated reinforcement mold.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
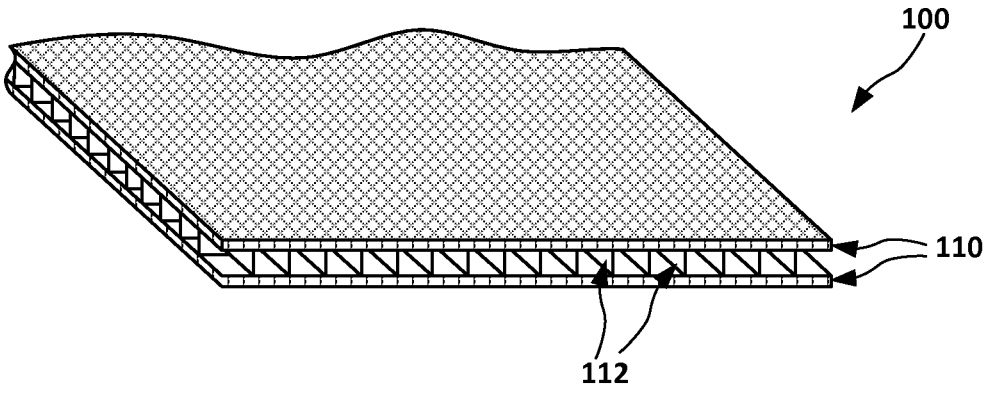
FIG. 1 shows example reinforcement material suitable for manufacturing reinforcement molds.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed.

Structural repair can be expensive, cumbersome, and time consuming. Structures can get damaged due to a variety of factors, such as earthquakes, overloading, weight of traffic, wear and tear, corrosion, explosions, internal fluid or gas pressure, and the like. Prevention is generally more cost-effective than repairs. As such, it is generally easier and more cost-effective to strengthen a structure that may be exposed to damaging forces and loads, than waiting to repair such eventual damages after they occur or to replace the structure with a new one. Intentional damage inflicted upon infrastructure, by terrorism or vandalism, is another way that structural damage may result. For example, recently, there has been growing interest to strengthen the above-mentioned structures for blast loading, such as terrorist attacks, which may seek to blow up a gas or oil pipeline by placing a bomb adjacent to the pipeline and detonating it. Also, some structures may be partly or completely immerged in water or other corrosive liquids, which can damage the structure over time. In addition to prevention, if damage does occur to a structure, a cost-effective and speedy method of repair is clearly desirable.

In many cases, the structure is not exposed in all sides or faces and wrapping a continuous layer of reinforcement material around the structure is not possible. In other cases repair may be necessary but long disruptions of service and functionality of the structure due to repair may not be affordable and, therefore, repair must be done quickly and efficiently on only portions of the structure that may be at relatively higher risk of damage or corrosion. An example of these structures is a seawall in Oxnard, Calif., constructed of concrete walls and concrete columns that are positioned along the concrete walls at regular intervals to strengthen the walls. These structures, and particularly these columns, are only accessible from the side(s) facing the water. The column portions of these structures, which often protrude away from the wall towards the water, may have three faces exposed but their back face, which is against the concrete wall, or against the soil, is not accessible for repair.

Exposure to water and the dry-wet cycles cause corrosion of these walls and columns and require repair. As another example, the ceiling of SunSweet Plant in Yuba City, Calif., is made of thousands of timber or glulam beams (laminated beam made of glued laminate layers), which stretch parallel to the ground and ceiling. The plant has added significant load to these beams by hanging new pipes from them and by adding new air-conditioning units on the roof. The beams require strengthening but only three faces of the beams (bottom and two sides) are accessible. The top side of each beam is attached to the roof and therefore is not accessible. At the same time, the plant operators cannot afford time-consuming repairs that disrupt their operation. As another example, at the present the city of Manila, Philippines, has potable water tanks that are leaking severely and cannot be dewatered for repairs. Therefore, the repairs must be performed from inside the tank using pre-manufactured molds according to this disclosure. Repair molds can be easily attached to the inside face of the tank with the help of divers. The above are only three examples of many such cases for which the present disclosure offers fast and economical repair and reinforcement.

Briefly described, a method and an article of manufacture are disclosed for reinforcing various structures having only a partly reachable external surfaces along the circumference, such as columns attached to walls or beams attached to ceilings, constructed from various materials including, but not limited to steel, concrete, masonry, wood, plastics, and the like. Other examples of structures are seawalls or sheet piles, or walls of tanks that are holding liquids, where it is necessary to perform the repairs very quickly using pre-manufactured shells. A prefabricated—formed and cured—mold or shell, described below in detail, fully or partly covers the exposed and reachable part of such a structure and is secured in place by different techniques. The mold or shell may hug the structure tightly or loosely and the space between the mold/shell and the structure may be filled with other curable materials such as glue, epoxy, grout, and the like.

To fabricate a mold or a shell multiple layers of various material sheets, each sheet having substantially the same or different properties, may be used in laminate form. In some embodiments, while the structure is surrounded by the mold or shell, any space between the structure and the mold may be filled by curable substances such as epoxy or grout. In various embodiments, the multiple layers, which together constitute a structure reinforcement mold/shell, may include a honeycomb layer sandwiched between other reinforcement layers. Such combination will reinforce the structure against external and internal loads and/or will protect the structure from, for example, corrosive gases and fluids. These loads may include weight, impact load, blast load, internal pressure, external load, ballistic load, and the like. In various embodiments, reinforcement mold or shell may include multiple honeycomb layers and multiple reinforcement sheets layered in various configurations and orders to enhance both strength and stiffness (or rigidity) of the shell. The stiffness of the mold or shell has at least two benefits: it allows the shells to be handled easily and it allows filling of the void behind it without the mold losing its shape due to the hydrostatic pressures caused by the weight of the wet grout or resin.

FIG. 1 shows an example reinforcement material 100 suitable for manufacturing reinforcement molds and shells. In this figure, an example honeycomb layer 112 is sandwiched between two fabrics 110 that are saturated by epoxy, creating a thick composite sheet. In various embodiments, the reinforcement material 100 may include multiple honeycomb layers 112 and multiple reinforcement sheets 110 layered in various configurations and orders. The honeycomb layer 112 is generally constructed of adjacent cells of various geometrical cell shapes, each cell having walls that enclose the cells. Within each of the cells and surrounded by the cell walls, a hollow space is created to reduce the weight of the honeycomb or hollow-structure layer. The cell walls create a relatively thick sheet, the thickness of the sheet being substantially determined by the height of the cell walls. Honeycomb layers have substantially greater stiffness compared to flat sheets of the same material without such cells and cell walls. In some embodiments corrugated structures may be used instead of the cell-based honeycomb layer 112 described previously. The manufacturing and availability of such corrugated structures may provide a cost advantage in some applications.

In various embodiments, some or all of the honeycomb or hollow-structure cells may be filled with one or more of a filler material, such as foam, concrete, polymer, and the like to displace the air within the cells and provide additional strength to the honeycomb or hollow-structure layer. The cell filling material may be injected or otherwise be placed within the cells after attaching the first honeycomb or hollow-structure skin layer, and then be covered and glued in place with the second skin layer. The skin layers themselves may be multi-layered in some embodiments. In some embodiments, foam or other sprayable materials may be used in lieu of honeycomb or hollow structure. Foam or other sprayable materials also serve as a spacer between reinforcing layers. In other embodiments foam or other sprayable materials may be first sandwiched between skin layers before adding them to reinforcing layers.

In some embodiments the honeycomb layer may be replaced by bubble-wrap structure with closed bubble cells. In various embodiments, closed bubble cells may be filled with filler material or pressurized air or gas. In various other embodiments, bubble cells may be inflatable to various adjustable pressures. In such embodiments, bubble-wrap structure may be wrapped around a structure in a deflated state and then be inflated to a desired pressure to obtain a predetermined stiffness.

The reinforcement mold or shell may be partly or completely constructed from Fiber Reinforced Polymer (FRP) products, for example those offered by QuakeWrap, Inc. of Tucson, Ariz. FRP products may be fabricated by saturating fabrics and reinforcement sheets, which are made with fiber or strands of carbon, glass, aramid, basalt, metal, etc., with a polymer such as polyester, vinyl ester, epoxy or cementitious grout and the like. An advantage of FRP products is that the number of layers of fibers or fabrics and their orientation may be varied to achieve the desired strength in any direction of the FRP. For example, fibers within an FRP fabric or reinforcement sheet may be aligned in one direction, in cross directions, randomly oriented, or in curved sections to provide various mechanical properties, such as tearing tendency and differential tensile strength along different directions, among others.

Another advantage of the FRP reinforcement molds and shells is stiffness and rigidity during the installation process. In other words, before the FRP molds/shells are bonded to the host structure and resist the loads as a single unit, FRP molds/shells can be handled easily and can resist the deformation loads, such as handling and weight loads, during the installation stage.

In regards to stresses caused by bending and torsion, the concept of FRP products is similar to the concept of I-beams that are used in steel and concrete construction. Those skilled in the art will appreciate how two structural surfaces separated by a distance along the respective normal vectors perpendicular to the planes of their surfaces (as seen in a common traditional I-beam where two "flanges" are separated by a "web") resist stresses. For example, depending on the direction of a bending force, one structural surface may be under tension and the other under compression. And, the stresses induced in these surfaces are inversely proportional to the separation distance between the structural surfaces. In other words, the larger the separation distances between the structural surfaces, the stiffer the structure will be. Similarly, a multi-layered FRP sheet, such as the one shown in FIG. 1, has two structural surfaces 110 separated by the distance created by the honeycomb layer 112. As such, the greater the separation between these surfaces, the stiffer the FRP sheet will be.

The core of the composite sheet or FRP shell can be any material such as foam or a honeycomb core such as those currently sold by PlasCore and NidaCore companies in the U.S. Alternatively, the core can be a 3-dimensional fabric. Such fabrics are made of reinforcing fibers on both faces with fiber strands connecting the two faces like short column. When exposed to resin, the short fibers rise and create a space between the two skin layers. The 3-D fabric can serve as the spacer and the FRP fibers and fabric can be bonded to its two faces to create a strong and stiff FRP shell. Alternatively, the construction of the 3-D fabric may be deigned to include the necessary layers of carbon, glass or other fibers as integral parts of the fabric. In such constructions of a shell, after introduction of resin, a stiff and strong shell will be created with no need to have additional FRP sheets as skin reinforcement.

Yet another advantage of the FRP mold is its resistance to corrosion or even heat. Corrosion resistance can be achieved by selecting a non-metallic fiber in the construction of the FRP mold. It is well known that fibers such as carbon, glass, aramid, basalt, etc. do not corrode and have a much longer service life than their metallic counterparts. An additional advantage of the FRP mold is the stopping or slowing down of the corrosion process of any steel that may exist in the host structure. The FRP mold constructed according to this disclosure is impervious and does not allow oxygen or moisture to pass through. Because oxygen is the fuel to the corrosion process, the FRP mold's ability to stop oxygen from reaching the steel behind the FRP mold in essence chokes off the corrosion process completely or at least lowers the corrosion rate significantly. This will further prolong the life of the host structure that is being repaired. This impervious feature of the shell, for example, can be used in repair or construction of sewer pipes to protect the upper half of the pipe where $H_2S$ gases accumulate and cause rapid deterioration of the pipe's crown region.

Yet another advantage of the FRP shell is to provide an architectural finish for the repaired host structure. As an example, when repairing a concrete structure, the outer face of the FRP shell can be coated with a textured coating similar to stucco. This coating can also provide further protection from UV rays or other elements for the FRP shell. The coating can also be painted or include pigments of different colors for further architectural enhancement. As a further example, the outer face of the FRP shell can be coated either with a wood veneer or a plastic film that looks like a wood veneer. The color and grain pattern in this veneer can be selected to blend in with the existing host structure to make the repair virtually inconspicuous after the FRP shell is installed.

While FRP shells may be constructed onsite, they may also be manufactured to the desired shape, strength and appearance in advance of the field installation. This reduces the construction time and disruption of service in the facility where the repairs are to be performed. Certain projects require payment of higher hourly wages to the workers on the construction site due to labor union or prevailing wage rules. Therefore, a further cost advantage of FRP shells is that they can be manufactured off-site, where the wages are lower.

Figure 2:
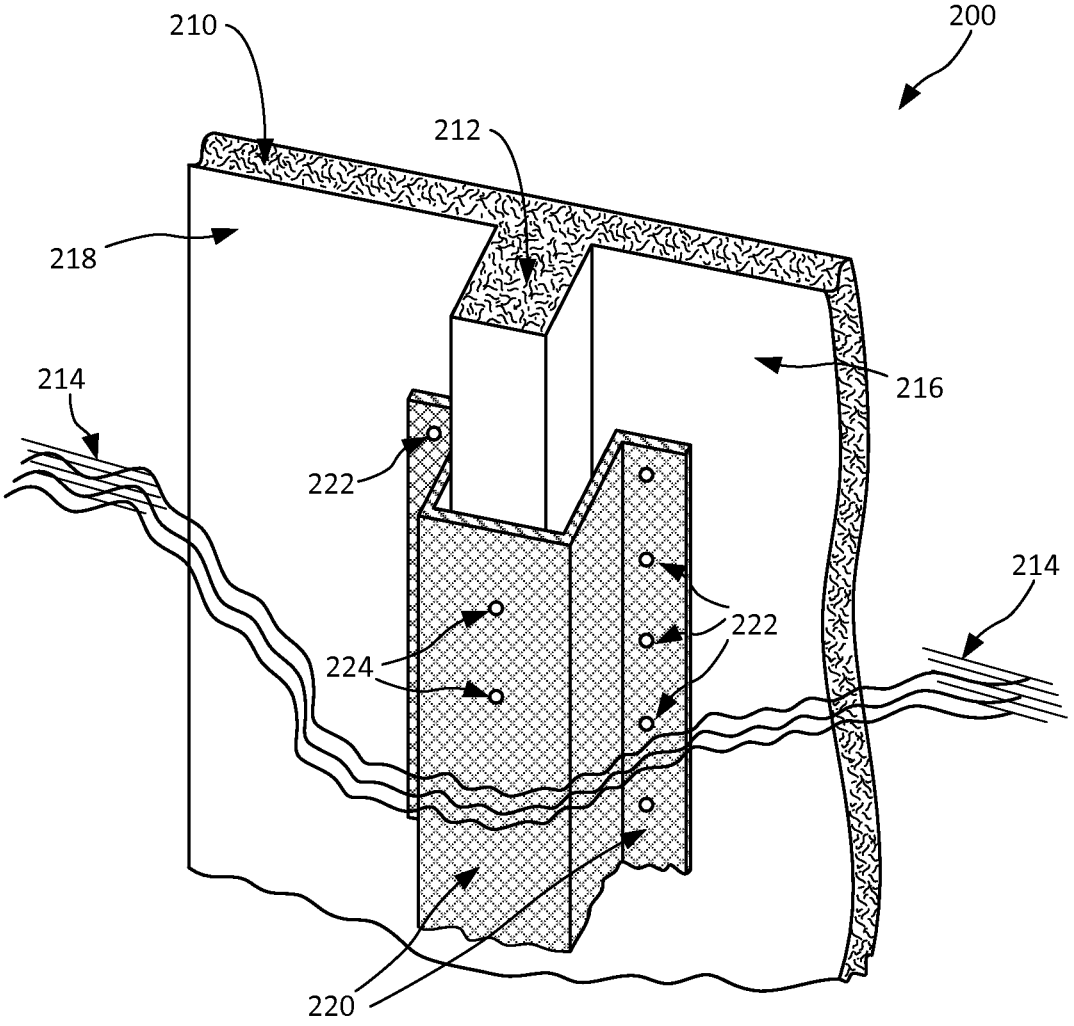
FIG. 2 shows an example structure to be reinforced and an example reinforcement mold.

FIG. 2 shows an example structure 212 and an example reinforcement mold 220. In this example, structure 212 is a column protruding out of wall 210. To reinforce such a column that is not exposed on all sides or faces, a closed-loop-reinforcement-shell cannot be applied, which entirely encloses structure 212 on all sides. In such circumstances, first a reinforcement shell/mold 220 of a desired shape and size is manufactured offsite and transported to the job site. At the job site, the reinforcement shell 220 is connected to the structural element 212 or to its surrounding wall faces 216 and 218 by epoxy or fasteners such as bolts 222 and 224, or any other desired attachment technique. Any space between the reinforcement shell 220 and the structural element 212 is filled with an epoxy or grout or the like. The combination 200 of the reinforcement shell 220 and the structural element 212 will be more resistant to corrosion and more durable under the loads than the structural element 212 alone. In this example, structural element 212 is partially below water level 214.

In addition, while this description mostly references using a honeycomb laminate and/or hollow-structure laminate sandwiched between one or more layers of reinforcement material sheets for fabricating reinforcement molds or reinforcement shells, it will be appreciated that the disclosure may include fewer or more laminate sheets of same or other similar structures and also include fewer or more reinforcement material sheets to reinforce columns or other types of structures, such as walls, sheet piles, pipes, tunnels, chambers, columns, and the like.

In the field, in one embodiment such as the one shown in FIG. 2, the FRP shells 220 are positioned against the host structure 212 where repairs are needed. The edges of the FRP shell 220 can be secured to the host structure 210 with bolts 222 and 224, as needed, and anchors that are positioned at appropriate spacing. Alternatively, the edges of the FRP shell 220 can be glued to the host structure 210 or a combination of mechanical anchors 222 and 224 and adhesives can be used to secure the FRP shell 220 in place. Next, the edges of the FRP shell 220 where it comes in contact with the host structure 210 will be sealed to create a small annular space between the FRP shell 220 and the structure 212. Next a polymer such as a resin or a cementitious or polymer grout is placed to fill that annular space and to bond the FRP shell 220 and the structure 212 together.

As it is well known to those skilled in the art, injection ports can be constructed on the FRP shell 220 to inject a resin in the annular space between the FRP shell 220 and the structure 212. The pressure of the injection and the weight of the resin that is heavier than water will push any water in the annular space to the top where it will ultimately flow out of the annular space until the annular space is filled with resin. An example of such resin is QuakeBond™ 320LV (Low Viscosity), produces by QuakeWrap, Inc. of Tucson, Ariz., which cures in water so it will not be necessary to pump the water out of the annular space before the resin is introduced.

The introduction of resin in the annular space between the FRP shell 220 and the structure 212 can also be achieved through vacuum. Once the edges of the FRP shell 220 are tightly sealed against the host structure, suction, for example with a small pump, can be introduced to draw the resin from one or more reservoirs through one or more ports into the annular space until the annular space is filled with resin and the FRP shell 220 is bonded to structure 212.

Figure 3:
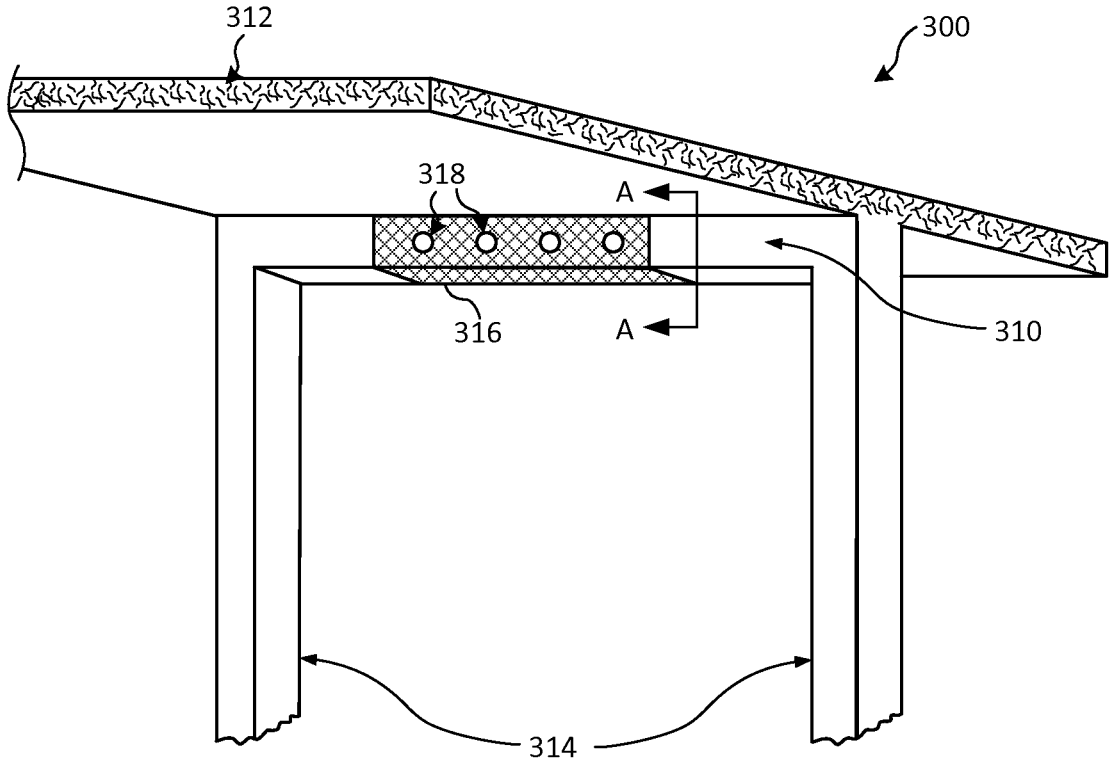
FIG. 3 shows another example structure to be reinforced and an example reinforcement mold configured to reinforce the structure.

FIG. 3 shows another example structure 310 to be reinforced and an example reinforcement mold 316 configured to reinforce the structure 310. In this example, structure 310 is a beam under ceiling 312, supported by columns 314. When a structural element such as a beam or column is repaired and strengthened by the disclosed method and apparatus, any loads applied to the structure will be resisted by the combined strengths of the host structure and the FRP shell. The FRP shell can be also installed in a manner to induce external pre-stressing in the structural element. In this approach, for example, for reinforcing horizontal beam 310, the FRP shell 316 and the beam 310 can be jacked up in a direction opposite to the weight of the beam, in this case upwards against gravity. Subsequently, the FRP shell 316 is bonded to the beam 310 in the deflected (jacked-up) position and the adhesive or epoxy is allowed to cure in that same position. Upon cure of epoxy and after the jacking forces are removed, the FRP shell 316 will immediately be subjected to some of the stresses caused by the weight of beam 310, and as mentioned before, any further loading of beam 310 will be resisted jointly by the FRP shell 316 and the host structure 310. This technique provides the added advantage of getting rid of any existing and excessive deflections in the floors or beams. In the embodiment of FIG. 3, shell 316 is attached to beam 310 by screws 318 in addition to being adhered to beam 310 by epoxy, grout, or the like.

Figure 4:
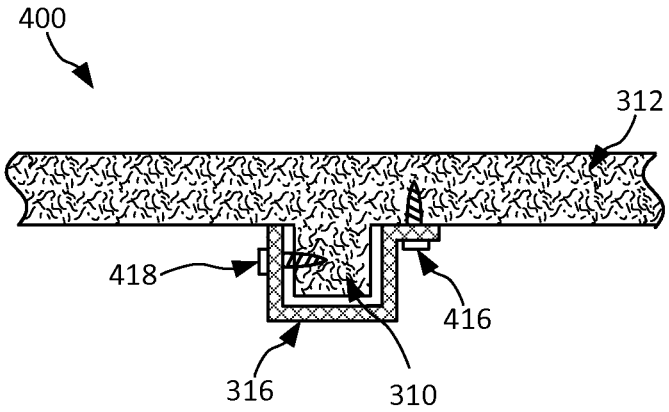
FIG. 4 shows an example cross-sectional view A-A of the example structure of FIG. 3.

FIG. 4 shows an example cross-sectional view A-A of beam 310 in FIG. 3. In FIG. 4, two example methods of attaching shell 316 to the host structure are shown. In one example method of attachment, screw 416 fastens shell 316 to ceiling 312. In the other example method, fastener 418 attaches shell 316 to beam 310. As mentioned before, the space between beam 310 and shell 316, which for example may be as wide as a millimeter or as large as an inch, may be filled with curable substances such as epoxy, grout, or the like.

Other reinforcing components, such as rebar, fiber, FRP fabric, wire, and/or wire mesh may be placed in the space between the shell 316 and beam 310. In various embodiments, before the introduction of epoxy, grout or concrete, additional reinforcement materials and components may be placed in the space between a mold/shell and the structure to be reinforced.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Those skilled in the art realize that although all examples presented in this disclosure are of concave type and include the structure within the shells and molds, in some embodiments the shells may be of planar or convex type to repair flat walls or inside walls of tunnels and water and sewer pipes.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A method of reinforcing a structure, external surfaces along a circumference of which are only partially reachable, the method comprising:

fabricating a rigid Fiber Reinforced Polymer (FRP) shell, formed in a mold and cured, to cover, at a distance, at least a part of the reachable surfaces of the structure;

covering, the at least a part of the reachable surfaces of the structure, for which the FRP shell is fabricated, by the FRP shell such that the FRP shell only surrounds the at least a part of the reachable surfaces, wherein there remains a space between the FRP shell and the structure;

securing the molded and cured FRP shell in place at the said distance from the surface of the structure; and filling the space between the FRP shell and the structure by a curable substance after securing the FRP shell in place.

2. The method of claim 1, wherein the structure is a column in close proximity of another structure or a beam supporting another structure or load.

3. The method of claim 1, wherein the FRP shell is manufactured using a combination of a honeycomb or a hollow-structure layer and an FRP reinforcement sheet.

4. The method of claim 3, wherein at least some cells of the honeycomb or of the hollow-structure layer are filled with a filler material.

5. The method of claim 3, wherein the FRP reinforcement sheet is fabricated by polymer-saturating one-, two-, or three-dimensional fabrics made with fiber or strands of carbon, glass, aramid, basalt, or metal.

6. The method of claim 1, wherein the FRP shell is fabricated by sandwiching at least a hollow-structure layer between at least two FRP reinforcement sheets.

7. The method of claim 1, wherein the curable substance is polyester, vinyl ester, epoxy, concrete, grout, or cementitious grout.

8. The method of claim 1, further including additional reinforcement elements placed in the space between the FRP shell and the structure.

9. The method of claim 8, wherein additional reinforcement elements are rebar, fiber, FRP fabric, wire, and/or wire mesh.

* * * * *